US009271573B2

(12) United States Patent
Su

(10) Patent No.: US 9,271,573 B2
(45) Date of Patent: Mar. 1, 2016

(54) MULTIFUNCTION CONTROL DEVICE

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 142 days.

(21) Appl. No.: 14/249,400

(22) Filed: Apr. 10, 2014

(65) Prior Publication Data

US 2015/0289654 A1 Oct. 15, 2015

(51) Int. Cl.

| | |
|---|---|
| ***A47C 1/032*** | (2006.01) |
| ***A47C 7/44*** | (2006.01) |
| ***A47C 7/62*** | (2006.01) |

(52) U.S. Cl.

CPC . *A47C 1/032* (2013.01); *A47C 7/44* (2013.01); *A47C 7/62* (2013.01)

(58) Field of Classification Search

CPC ..... A47C 1/032; A47C 1/03205; A47C 7/44

USPC ..... 297/300.1, 301.1, 302.1, 463.1

See application file for complete search history.

(56) References Cited

U.S. PATENT DOCUMENTS

| | | | | | |
|---|---|---|---|---|---|
| 3,756,654 | A * | 9/1973 | Bauer | A47C 3/026 | 297/301.1 |
| 4,364,605 | A * | 12/1982 | Meiller | A47C 1/0244 | 297/300.3 |
| 4,589,697 | A * | 5/1986 | Bauer | A47C 1/0244 | 297/301.2 |
| 4,838,510 | A * | 6/1989 | Holstensson | A47C 1/0244 | 297/300.3 |
| 6,213,552 | B1 * | 4/2001 | Miotto | A47C 1/03238 | 297/300.5 |
| 6,513,879 | B1 * | 2/2003 | Stern | A47C 3/30 | 297/300.3 |
| 6,588,843 | B1 * | 7/2003 | Ebenstein | A47C 1/03238 | 297/300.1 |
| 6,595,593 | B2 * | 7/2003 | Elam | A47C 1/024 | 297/463.1 |
| 2002/0140277 | A1 * | 10/2002 | Pan | A47C 1/022 | 297/463.1 |
| 2003/0015902 | A1 * | 1/2003 | Knoblock | A47C 1/023 | 297/300.1 |
| 2007/0228801 | A1 * | 10/2007 | Matern | A47C 1/03233 | 297/463.1 |

* cited by examiner

*Primary Examiner* — Peter Brown

(57) ABSTRACT

The control device includes a seat having a positioning hole. An elevation support connects a first control line and is pivoted to the seat. A control lever has a connecting base received in the receiving room. The connecting base has a receiving hole, a connecting trough and a driving shaft. A tilt support has a through hole and connects a second control line. A cover assembled with the seat has a rotation hole. A rotation support has a cap and a bar. The bar has an insert hole and passes the rotation hole, the through hole and the connecting trough. A bolt passes through the insert hole and the receiving hole.

12 Claims, 7 Drawing Sheets

MULTIFUNCTION CONTROL DEVICE

BACKGROUND OF THE INVENTION

1. Technical Field

The invention relates to chairs, particularly to adjustment control structures for chairs.

2. Related Art

In recently years, chairs have great an improvement in ergonomics. Some office chairs are provided with multiple adjustment functions, for example, vertical and horizontal positions of cushion, and back tilt. Such multiple adjustment functions provide user great comfort.

Though a modern office chair possesses multiple adjustment functions, each function needs an independent structure to accomplish. In other words, a multifunctional chair has several adjustment mechanisms. This always makes users confused because it is hard to determine which mechanism should be operated or even hard to find where the mechanism is. It is not convenient for users.

SUMMARY OF THE INVENTION

An object of the invention is to provide a multifunction control device, which integrates multiple control mechanisms to make operation easy and convenient.

To accomplish the above object, the control device of the invention includes a seat having a positioning hole. An elevation support connects a first control line and is pivoted to the seat. A control lever has a connecting base received in the receiving room. The connecting base has a receiving hole, a connecting trough and a driving shaft. A tilt support has a through hole and connects a second control line. A cover assembled with the seat has a rotation hole. A rotation support has a cap and a bar. The bar has an insert hole and passes the rotation hole, the through hole and the connecting trough. A bolt passes through the insert hole and the receiving hole.

By the above structure, operating the control lever can make the connecting base turn left, right, up and down. When the driving shaft of the connecting base presses and rotates the elevation support, the elevation support pulls the first control line so that the elevation adjustment mechanism of a cushion can be driven to adjust cushion elevation. In addition, changing the operation direction of the control lever can move the tilt support and rotation support so that the second control line can be pulled to adjust back tilt. Thus only one control device can obtain at least two kinds of adjustments.

The receiving room is formed with a division. A post is vertically received in the division for supporting the cushion. A receiving trough is formed in the post for receiving a spring. The spring is used to adjust a position of the post. An outside of the post is formed with a protrusion. The connecting base is formed with an alcove corresponding to the protrusion. The protrusion can be driven by the connecting base to press down the post. In a normal state, the post protrudes into the cushion to prevent the cushion from moving. When needing to move the cushion, only operating the control lever to release the post is needed.

The connecting base is of a substantially spherical shape. The connecting base is received in the receiving room and rotatably positioned on the cylinder.

The cover has a limiting base toward the receiving room. The limiting base partially receives a rolling ball. A periphery of the tilt support is formed with limiting indents. The rolling ball falls in one of the limiting indents to temporarily position the tilt support. This can prevent the tilt support from overrotating to damage other components.

DETAILED DESCRIPTION OF THE INVENTION

Figure 1:
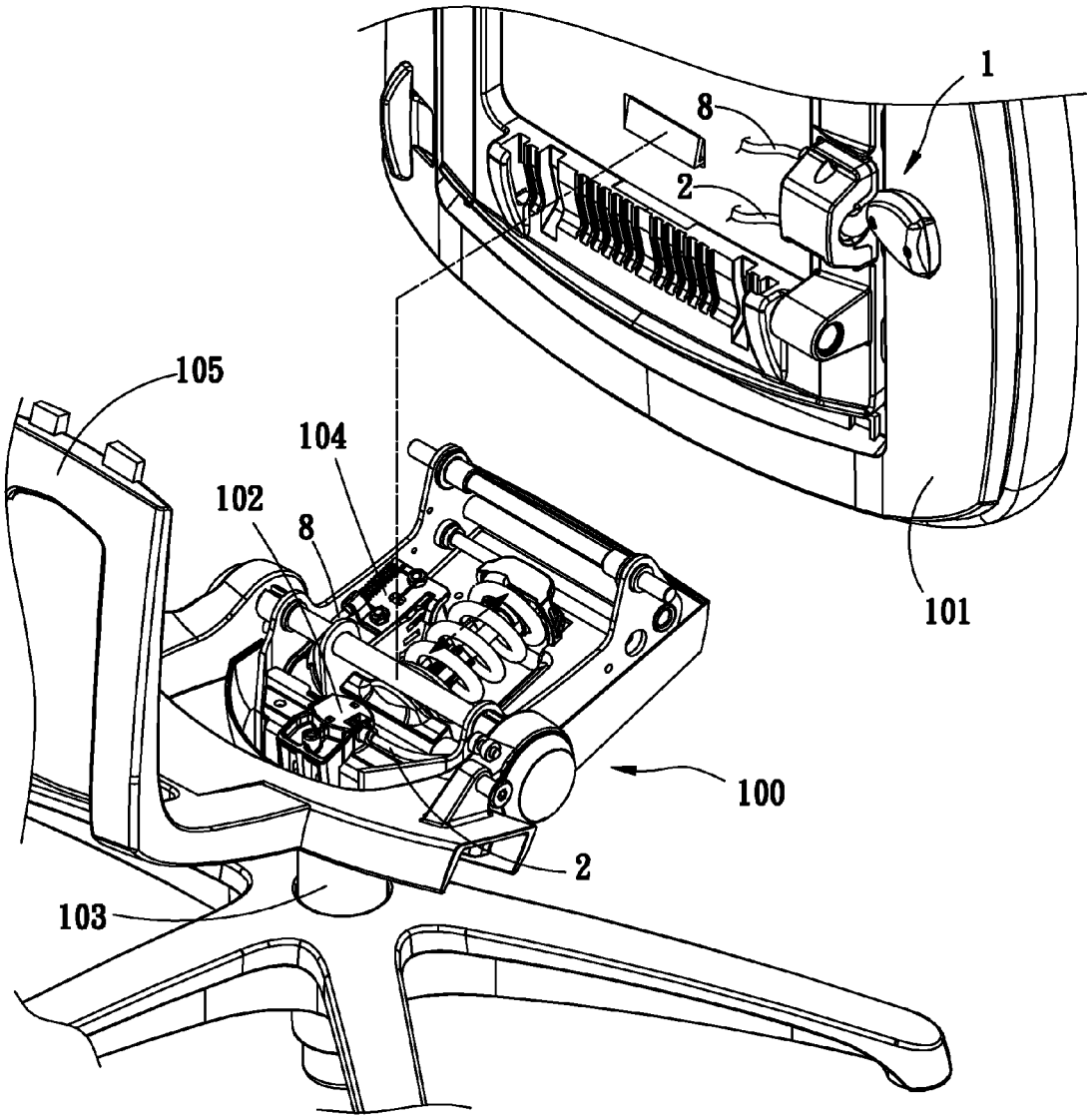
FIG. 1 is a schematic view of the invention installed in a chair.
Figure 2:
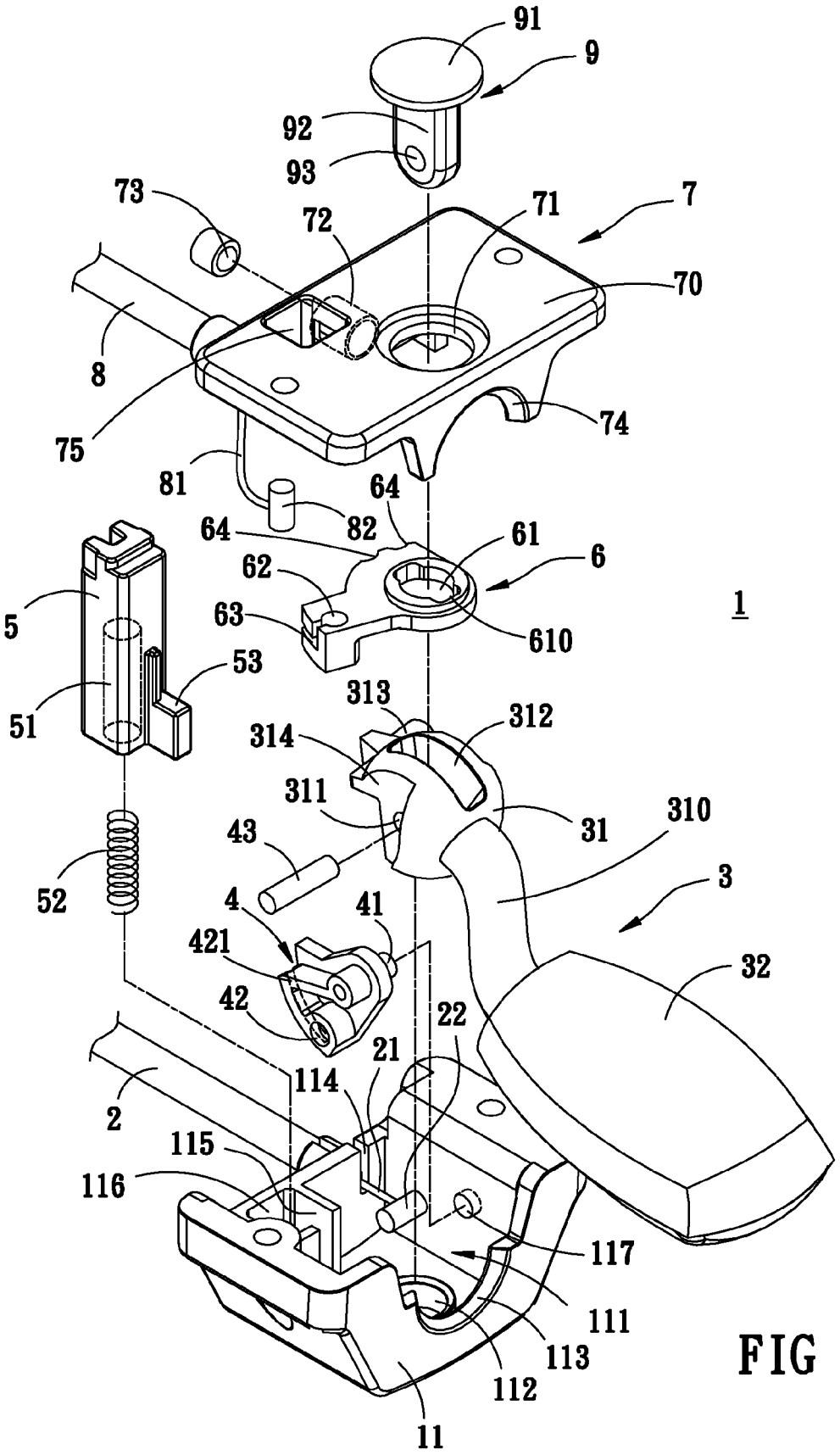
FIG. 2 is an exploded view of the invention.

Please refer to FIGS. 1 and 2. The control device of the invention is disposed under a cushion 101 of a chair 100. The control device 1 includes a seat 11 with a receiving room 111. The bottom of the receiving room 111 is formed with a cylinder 112. One side of the seat 11 is formed with a first recess 113. Another side of the seat 11 is formed with a slot 114 and a partition 115. A division 116 is formed in the receiving room 111 by the partition 115.

The seat 11 has a first control line 2 for remotely controlling elevation of the cushion 100. The first control line 2 has a first cable 21 with a terminal 22. The first cable 21 passes through the slot 114. The seat 11 is disposed with a control lever 3. The control lever 3 has a connecting base 31 with a substantially spherical shape. The connecting base 31 is received in the receiving room 111 and rotatably positioned on the cylinder 112. The connecting base 31 is formed with a receiving hole 311, a connecting trough 312 communicating with the receiving hole 311, and a driving shaft 313 toward an elevation support 4. A lever 310 with a handle 32 is connected to the connecting base 31. The lever 310 passes through the first recess 113 to expose the handle 32 to the outside, so that the handle 32 can be operated by a user.

The elevation support 4 is arranged beside the connecting base 31. The elevation support 4 has a pivot 41 and a terminal hole 42. The seat 11 is formed with a positioning hole 117 for being inserted by the pivot 41 so that the elevation support is rotatably supported. The driving shaft 313 extends to a rotating path of the elevation support 4. Additionally, the elevation support 4 has a cable channel 412 communicating with the terminal hole 42 for being passed by the first cable 21. The terminal 22 is embedded in the terminal hole 42 so that the elevation support 4 can be controlled by the first cable 21. A distal end of the first cable 21 connects to an elevation adjustment mechanism 102 of the chair 100. The elevation adjustment mechanism 102 further connects a gas spring 103 which adjustably elevates the cushion 101. By operating the first control line 2 to activate the elevation adjustment mechanism 102 can control the gas spring 103 to adjust elevation of the cushion 101.

A post 5 is vertically received in the division 116 for supporting the cushion 101. A receiving trough 51 is formed in the post 5 for receiving a spring 52. The spring 52 is used to adjust a position of the post 5. An outside of the post 5 is formed with a protrusion 53. The connecting base 31 is formed with an alcove 314 corresponding to the protrusion 53. The protrusion 53 can be driven by the connecting base 3 to press down the post 5.

A tilt support 6 is disposed atop the connecting base 31. The tilt support 6 has a through hole 61 and two interference holes 610 communicating with the through hole 61. The through hole 61 corresponds to the connecting trough 312 in position. A periphery of the tilt support 6 is formed with limiting indents 64 for preventing over-rotation. The tilt support 6 is further formed with a terminal hole 62 and a cable channel 63 communicating therewith.

A cover 11 is assembled with the seat 11 to protect the control device 1. The cover 7 has a rotation hole 71, a post hole 75 for being passed by the post 5, and a limiting base 72 toward the receiving room 111. The limiting base 72 partially receives a rolling ball 73. The cover 7 is formed with a second recess 74 corresponding to the first recess 113. Both the first recess 113 and the second recess 74 define a space which allows the control lever 3 to move. The cover 7 is provided with a second control line 8 for adjusting the elasticity of tilt of the chair back 105. A second cable 81 is received in the second control line 8. An end of the second cable 81 is a terminal 82. The terminal 82 is embedded in the terminal hole 62 of the tilt support 6. The second control line 81 passes through the cable channel 63. A distal end of the second cable 81 connects an elasticity adjustment mechanism 104 of the back 105. Thus the elasticity adjustment mechanism 104 can be triggered by the second control line 8 to adjust the elasticity of back tilt.

The rotation hole 71 is passed by a rotation support 9. The rotation support 9 has a cap 91 plugging the rotation hole 71. A bar 92 extends from the cap 91. The bar 92 passes the rotation hole 71, the through hole 61, the interference holes 610 and the connecting trough 312. The bar 92 has an insert hole 93 corresponding to the receiving hole 311 in position for being inserted by a bolt 43 to fasten the rotation support 9 and the connecting base 31.

Figure 3:
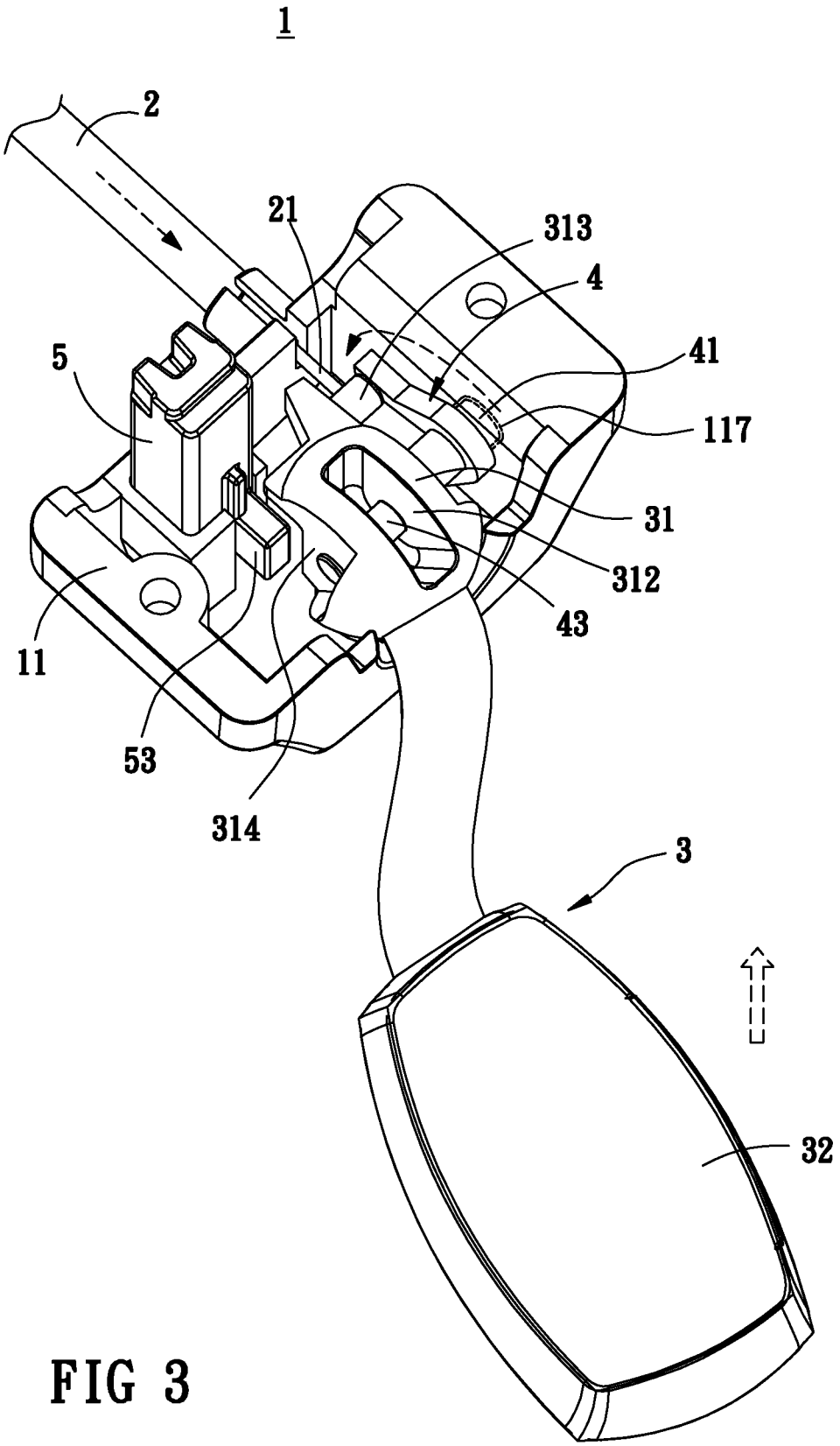
FIG. 3 is a schematic view of the invention showing operation of the first control line.
Figure 4:
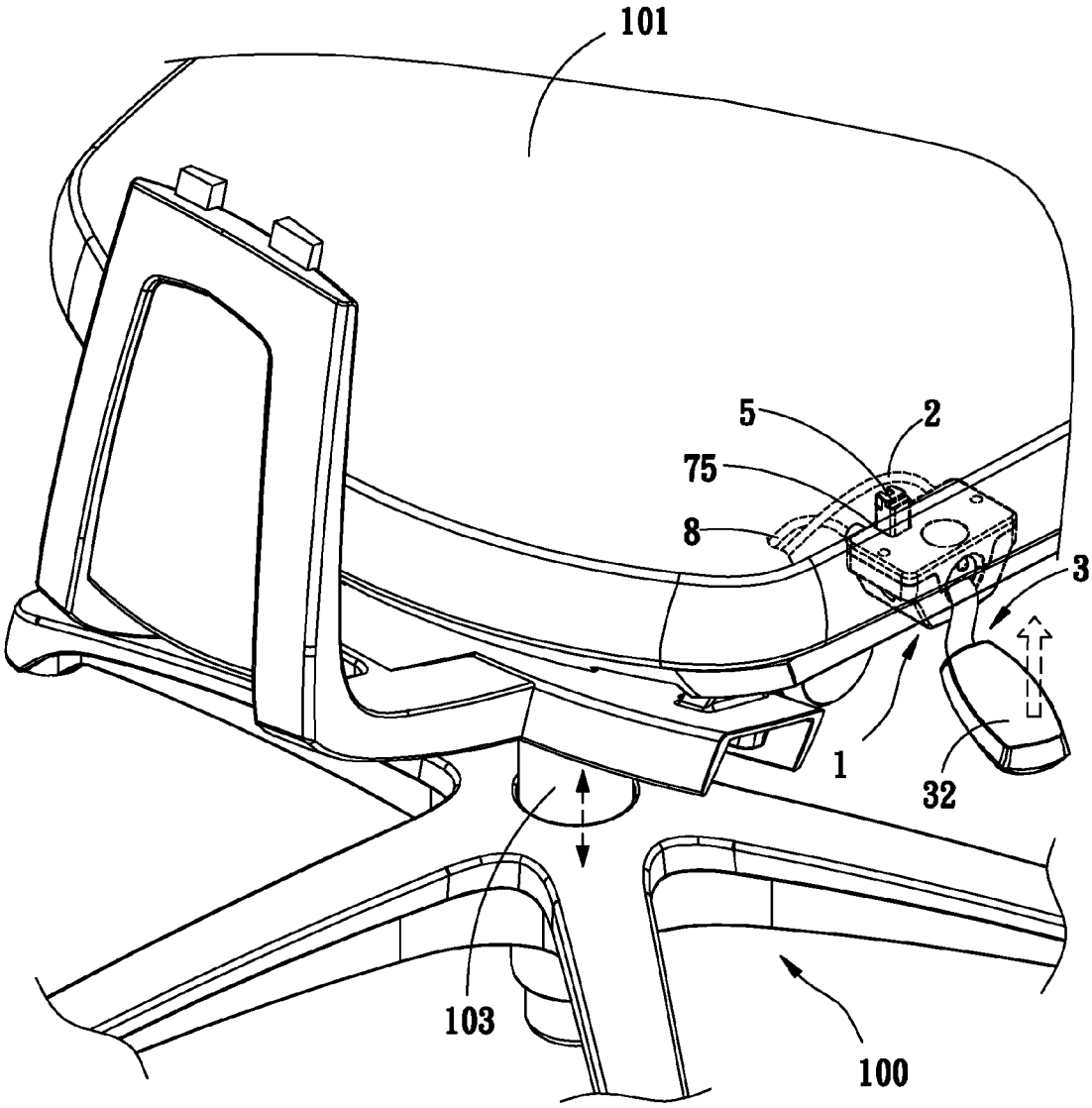
FIG. 4 is a schematic view of the invention showing operation of cushion elevation.

When assembling, as shown in FIG. 3, the connecting base 31 is placed on the cylinder 112 of the seat 11. The pivot 41 of the elevation support 4 is inserted into the positioning hole 117 of the seat 11. The spring 52 is placed in the receiving trough 51 and then the post 5 is placed in the division 116. The spring 52 is stopped by the seat 11. In a normal state as shown in FIG. 4, the post 5 is pushed by the spring 52 to retractably protrude from the post hole 75 and reach the cushion 101, so that the cushion cannot move. Finally, the tilt support 6 and rotation support 9 are installed on the connecting base 31. Because the rotation support 9 and the tilt support 6 interfere each other, the connecting base 31, rotation support 9 and tilt support 6 will move together. Though the connecting base 31 of the control lever 3 is restrained by other elements, the spherical connecting base 31 can still be turn left, right, up and down by operating the handle 32.

When operating, as shown in FIGS. 3 and 4, the handle 32 is pushed up, the driving shaft 313 presses and rotates the elevation support 4. The rotation of the elevation support 4 pulls the first cable 21 to activate the elevation adjustment mechanism 102 and the gas spring 103. Thus the cushion height can be adjusted.

Figure 5:
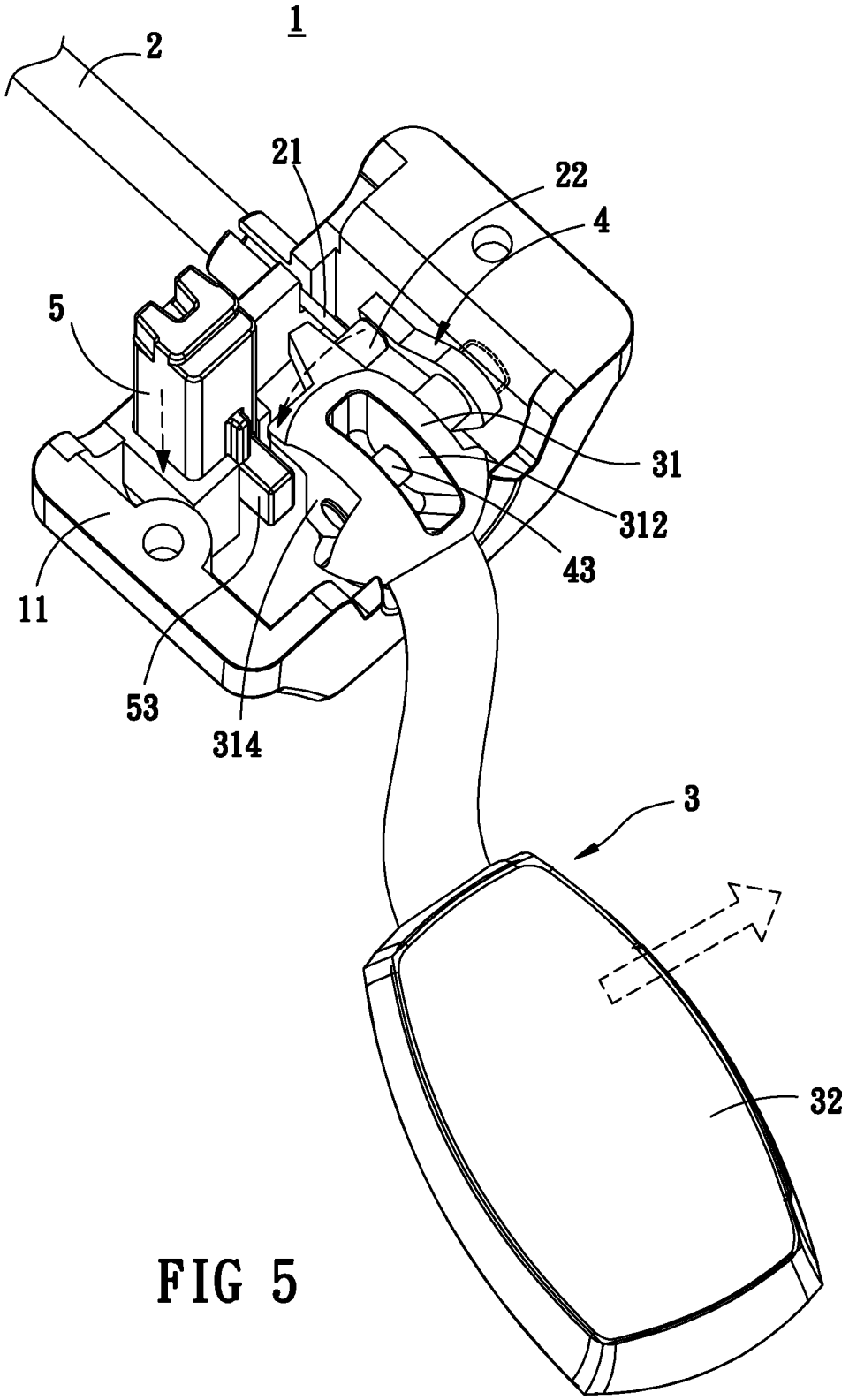
FIG. 5 is a schematic view showing operation of the engagement post and the handle.
Figure 6:
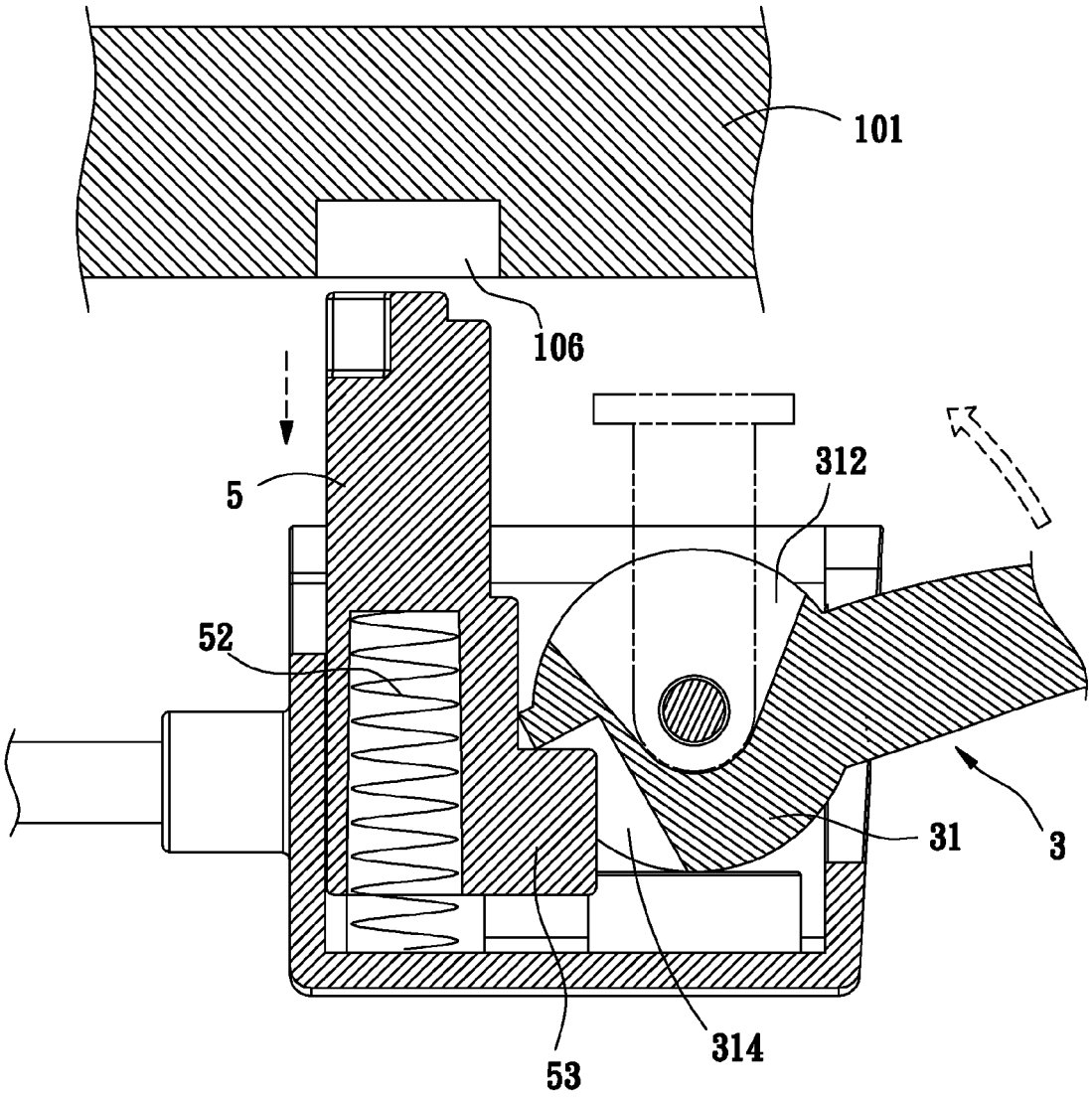
FIG. 6 is a schematic view of the invention showing adjustment operation of the cushion.

Please refer to FIGS. 5 and 6. When adjusting the position of the cushion 101, the handle 32 needs to be moved right so as to shift the alcove 314 to the protrusion 53 to receive it. At this time, the handle 32 is moved up to make the connecting base 31 press down the protrusion 53 so that the post 5 can be released from the cushion 101 and the cushion 101 can be free. After the cushion 101 has been moved to a desired position, release the handle 32 to make the post 5 stop the cushion 202 by restoring the post to the position 106 due to the spring 52.

Figure 7:
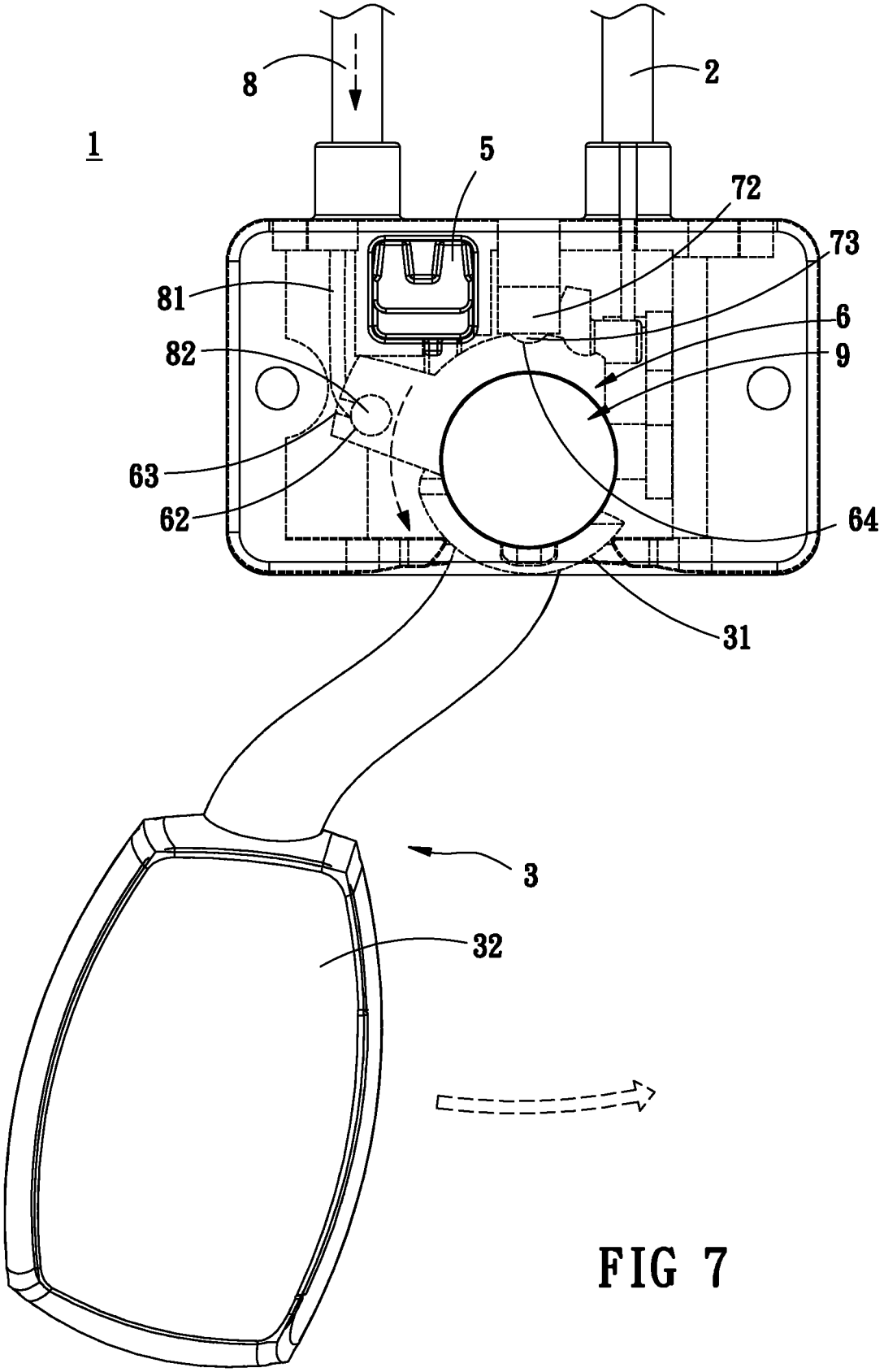
FIG. 7 is a schematic view of the invention showing tilt flexibility adjustment of the chair back.

Please refer to FIGS. 1 and 7. When adjusting the elasticity of the back 105 tilt, the handle 32 needs to be moved right to move the tilt support 6 and the rotation support 9 to the left. The second cable 81 is pulled to drive the elasticity adjustment mechanism 104. In this process, the rolling ball 73 falls in one of the limiting indents 64 to temporarily position the tilt support 6. This can prevent the tilt support 6 from overrotating to damage other components.

What is claimed is:

1. A multifunction control device comprising:

a seat, having a receiving room, one side thereof being provided with a positioning hole;

an elevation support, connecting a first control line, having a pivot rotatably passing through the positioning hole;

a control lever, having a connecting base received in the receiving room, the connecting base having a receiving hole, a connecting trough and a driving shaft toward the elevation support, and the driving shaft extending to a rotating path of the elevation support;

a tilt support, being atop the connecting base, having a through hole and an interference hole communicating with the through hole, connecting a second control line, and the through hole corresponding to the connecting trough;

a cover, assembled with the seat, and having a rotation hole;

a rotation support, having a cap plugging the rotation hole, a bar extending from the cap, the bar passing the rotation hole, the through hole, the interference hole and the connecting trough, and the bar having an insert hole corresponding to the receiving hole; and a bolt, passing through the insert hole and the receiving hole to connect the tilt support, the rotation support and the connecting base.

2. The control device of claim 1, wherein the connecting base is spherical in shape, and the connecting base is received in the receiving room and rotatably positioned on a cylinder formed in the receiving room.

3. The control device of claim 1, wherein an end of the first cable connects to an elevation adjustment mechanism of a chair, and an end of the second cable connects an elasticity adjustment mechanism of a chair back.

4. The control device of claim 1, wherein the cover has a limiting base toward the receiving room, the limiting base partially receives a rolling ball, a periphery of the tilt support is formed with limiting indents, and the rolling ball falls in one of the limiting indents to temporarily position the tilt support.

5. The control device of claim 1, wherein the cover has a post hole for being passed by the post, the receiving room is formed with a division for receiving the post, a receiving trough is formed in the post for receiving a spring, an outside end of the spring abuts against the seat, and an outside of the post is formed with a protrusion.

6. The control device of claim 5, wherein the connecting base is spherical in shape, and the connecting base is formed with an alcove corresponding to the protrusion.

7. The control device of claim 6, wherein the connecting base is received in the receiving room and rotatably positioned on a cylinder formed in the receiving room.

8. A multifunction control device comprising:

a seat, having a receiving room, a division being formed therein;

a control lever, having a connecting base received in the receiving room, the connecting base having a receiving hole and a connecting trough communicating with the receiving hole;

a tilt support, being atop the connecting base, having a through hole and an interference hole communicating with the through hole, and connecting a control line;

a cover, assembled with the seat, and having a rotation hole and an engagement hole;

a rotation support, having a cap plugging the rotation hole, a bar extending from the cap, the bar passing the rotation hole, the through hole, the interference hole and the connecting trough, and the bar having an insert hole corresponding to the receiving hole;

a bolt, passing through the insert hole and the receiving hole to connect the tilt support, the rotation support and the connecting base; and a post, received in the division, projecting from the engagement hole, having a receiving trough and a protrusion, a spring being received in the receiving trough, an end of the spring being connected to the seat, and the protrusion engaging with the connecting base.

9. The control device of claim 8, wherein the connecting base is spherical in shape, and the connecting base is formed with an alcove corresponding to the protrusion.

10. The control device of claim 9, wherein the connecting base is received in the receiving room and rotatably positioned on a cylinder formed in the receiving room.

11. The control device of claim 8, wherein an end of the cable connects an elasticity adjustment mechanism of a chair back.

12. The control device of claim 8, wherein the cover has a limiting base toward the receiving room, the limiting base partially receives a rolling ball, a periphery of the tilt support is formed with limiting indents, and the rolling ball falls in one of the limiting indents to temporarily position the tilt support.

* * * * *